US012460396B2

(12) United States Patent
Knowles

(10) Patent No.: US 12,460,396 B2
(45) Date of Patent: Nov. 4, 2025

(54) LOCKING ASSEMBLY FOR A SHROUD FOR A GROUND ENGAGING TOOL

(71) Applicants: SANDVIK MINING AND CONSTRUCTION AUSTRALIA (PRODUCTION SUPPLY) PTY LTD, Brisbane (AU); SANDVIK MINING AND CONSTRUCTION OY, Tampere (FI)

(72) Inventor: Bruce Knowles, Roleystone (AU)

(73) Assignees: Sandvik Mining and Construction Oy, Tampere (FI); Sandvik Mining and Construction Australia (Production/Supply) Pty Ltd, Milton (AU)

( * ) Notice: Subject to any disclaimer, the term of this patent is extended or adjusted under 35 U.S.C. 154(b) by 727 days.

(21) Appl. No.: 17/801,621

(22) PCT Filed: Feb. 27, 2020

(86) PCT No.: PCT/EP2020/055133
§ 371 (c)(1),
(2) Date: Aug. 23, 2022

(87) PCT Pub. No.: WO2021/170237
PCT Pub. Date: Sep. 2, 2021

(65) Prior Publication Data
US 2023/0083042 A1 Mar. 16, 2023

(51) Int. Cl.
*E02F 9/28* (2006.01)

(52) U.S. Cl.
CPC ..... *E02F 9/2883* (2013.01); *E02F 9/2833* (2013.01); *E02F 9/28* (2013.01); *E02F 9/2816* (2013.01)

(58) Field of Classification Search
CPC ..... E02F 9/2833; E02F 9/2808; E02F 9/2825; E02F 9/2883
See application file for complete search history.

(56) References Cited

U.S. PATENT DOCUMENTS 3,141,508 A * 7/1964 Eberhart ..... A01B 13/08 172/744
3,471,954 A * 10/1969 Spivey ..... E02F 9/2841 37/457
3,481,057 A * 12/1969 Zink ..... E02F 9/2866 37/447
3,512,838 A * 5/1970 Kniff ..... E21C 35/19 299/107

(Continued)

FOREIGN PATENT DOCUMENTS

WO 2010065990 A1 6/2010
WO 2014037780 A1 3/2014
WO 2016089669 A1 6/2016

*Primary Examiner* — Christopher J Sebesta
*Assistant Examiner* — Audrey L Lusk
(74) *Attorney, Agent, or Firm* — Corinne R. Gorski

(57) ABSTRACT

A locking assembly is arranged for releasably locking a shroud to a carrier. The locking assembly includes a main body, a piston and a bolt provided with a thread engaging a corresponding thread of the piston for controlling the position of the piston relative to the main body. The locking assembly also includes a retaining arrangement including a plurality of balls securing the bolt within a central recess of the main body.

8 Claims, 3 Drawing Sheets

(56) References Cited

U.S. PATENT DOCUMENTS 3,650,053 A * 3/1972 Baer ..... F16B 21/125 37/457
3,912,020 A * 10/1975 Rockwell ..... E02F 5/32 172/699
4,484,783 A * 11/1984 Emmerich ..... E21C 35/197 411/15
4,575,156 A * 3/1986 Hunter ..... E21C 35/197 37/458
4,611,418 A * 9/1986 Launder ..... E02F 9/2891 403/328
4,727,663 A * 3/1988 Hahn ..... E02F 9/2841 37/458
4,736,533 A * 4/1988 May ..... E02F 9/2841 37/456
6,119,378 A * 9/2000 Pippins ..... E02F 9/2891 37/458
6,685,273 B1 * 2/2004 Sollami ..... B28D 1/188 299/110
7,219,454 B2 * 5/2007 Maher ..... E02F 9/2833 37/456
7,472,503 B2 * 1/2009 Maher ..... E02F 9/2841 37/458
8,292,372 B2 * 10/2012 Hall ..... E21C 35/18 299/102
9,540,796 B2 * 1/2017 Dallard ..... E02F 9/2841
11,879,235 B2 * 1/2024 Serrurier ..... E02F 9/2833
2001/0052196 A1 * 12/2001 Pippins ..... E02F 9/2891 37/456
2002/0023375 A1 * 2/2002 Pippins ..... E02F 9/2833 37/456
2006/0078373 A1 * 4/2006 Dingwall ..... E02F 9/2841 411/351
2006/0255653 A1 * 11/2006 Gibbins ..... E02F 9/2841 301/43
2011/0030248 A1 * 2/2011 Clendenning ..... E02F 9/2825 37/456
2013/0269221 A1 * 10/2013 Pippins ..... E02F 9/285 37/456
2014/0182174 A1 * 7/2014 Clendenning ..... E02F 9/2833 37/456
2015/0007464 A1 * 1/2015 Simpson ..... E02F 9/2825 37/456
2016/0160474 A1 * 6/2016 Kunz ..... E02F 9/2841 37/456
2016/0222634 A1 * 8/2016 Chiolerio ..... E02F 9/2825
2016/0281336 A1 * 9/2016 Clendenning ..... E02F 9/2825
2017/0321396 A1 * 11/2017 Zenier ..... E02F 9/2883
2018/0044895 A1 * 2/2018 Rol Corredor ..... E02F 9/2841

* cited by examiner

LOCKING ASSEMBLY FOR A SHROUD FOR A GROUND ENGAGING TOOL

RELATED APPLICATION DATA

This application is a § 371 National Stage Application of PCT International Application No. PCT/EP2020/055133 filed Feb. 27, 2020.

TECHNICAL FIELD

The present invention relates to mechanical connection of wear parts to underlying structures and has been created in relation to the connection of ground engaging tools to buckets of earth-moving equipment but could be used to attach a shroud for wear protection to any type of carrier.

BACKGROUND

Ground engaging tools (GET), for earth-moving equipment, such as those used in mining operations, operate in a highly abrasive environment, are subjected to high impact forces and therefore wear out or become damaged through use. GET, such as teeth used on the front lip or edges of a bucket of the earth moving equipment, therefore require regular replacement.

Traditionally, GET are welded onto the lips of buckets. When the GET come to the end of their useful life, they can be cut from the bucket, and new GET welded in their place.

It will be appreciated that such cutting and re-welding operations are complex, time-consuming and relatively expensive. Further, they must generally be done in a workshop to ensure the cutting off and welding is done correctly, requiring the bucket to be transported away from the earth-moving equipment.

Various mechanical attachment methods have been proposed in an attempt to alleviate these problems. Many of the methods involve the use of bolts and similar fastening devices, inserted within the lip of the bucket. In general, such devices have proved to be of limited use. The insertion of a bolt or similar within a bucket lip can lead to undesirable stress concentrations within the lip, resulting in cracking of the bucket lip. Even where this is avoided, the large forces to which GET are exposed have a tendency to deform connecting bolts, thus making difficult their subsequent extraction using mechanical tools. Indeed, in some cases the deformation can be so severe that the GET must be cut away, completely negating any advantage of mechanical connection.

In response to these issues, the applicant has devised a number of mechanical connection means which overcome these problems. Examples of the applicant's devices are detailed in U.S. Pat. No. 7,219,454, in U.S. Pat. No. 7,472,503 and in U.S. patent application Ser. No. 13/133,213 (also published as International PCT publication number WO 20 0/065990), the contents of all of which are included herein by reference.

These connection means involve the use of a shroud which mounts about a lug or boss on the lip of an excavator bucket; a locking device which locates between the shroud and the boss; and the application of an external compressing force to maintain the relative position of the shroud, locking device and boss.

Although these connection means have proved far less susceptible to deformation than previous mechanical connectors, there have nonetheless been occasions where the connection means have had one or more problems.

Sometimes failure of the GET or connection means can occur when the GET is in use due to a load being applied which is higher than the means can bear. The number of individual components forming the connection means can make fitting/refitting a GET time consuming. Other times, when it is necessary to remove the GET, the connection means is troublesome to undo to release the GET from the bucket, or, even if the connection means is released, the GET does not readily remove from the bucket lip, usually because of dirt and/or deformation of the connection means and/or GET preventing removal.

In response to these challenges, the applicant has devised in WO2014037780A1 a locking assembly for releasably locking a shroud to a carrier by which removal and preferably application of the GET to the carrier of earthmoving equipment is improved.

However, it has been found that large forces and general abuse of the shroud and carrier in use sometimes deform or damage the connection means/locking assembly such that detachment of the shroud is difficult or impossible.

SUMMARY

Accordingly, an object of the invention is to provide an improved locking assembly for releasably locking a shroud to a carrier.

According to a first aspect, this object is achieved by a locking assembly arranged for releasably locking a shroud to a carrier and comprises a piston and a main body provided with a through central recess for receiving the piston such that the piston is movable back and forth along a longitudinal axis of the recess with an outer end portion of the piston extending outside the recess of the main body. The locking assembly further comprises a bolt provided within the central recess, wherein the bolt comprises a shank and a gripping portion extending through a first end opening of the central recess such that the gripping portion is accessible from outside the main body for rotation of the bolt. Also, at least a portion of the shank is provided with a thread engaging a corresponding thread of the piston. The bolt is provided with a first bearing surface facing a corresponding second bearing surface of the main body, wherein the first and second bearing surfaces are configured such that when the bolt is rotated to force the piston out of the central recess, the first bearing surface of the bolt bears against the second bearing surface of the main body thereby preventing movement of the bolt in a first direction along the longitudinal axis. The locking assembly 1 further comprises a retaining means for preventing movement of the bolt in a second direction opposite the first direction. The retaining means is provided in the central recess with an outer surface of the retaining means facing an inner surface of the central recess.

The outer surface of the retaining means is provided with a first recess extending at least partly around the circumference of the retaining means, wherein the inner surface of the central recess is provided with a second recess extending at least partly around the circumference of the inner surface of the main body. The first recess and the second recess jointly define an intermediate space for receiving a plurality of balls distributed about the longitudinal axis such that the balls limit movement of the retaining means in the second direction relative to the main body. The retaining means is either a) integrated with the bolt, or b) provided as a separate part positioned around the shank of the bolt and adapted to limit movement of the bolt relative to the retaining means in the second direction.

The locking assembly is designed to work on the same principles as the prior art locking assembly PA-110/PA-30 shown in FIGS. 1 and 2 and described in WO2014037780A1. Specifically, the locking assembly is used for mechanically locking a shroud to a carrier once the carrier has been positioned on the lip of the carrier. In order to achieve the locking action, the locking assembly is inserted into a predetermined position between portions of the shroud and the carrier respectively. Once correctly positioned, the length of the locking assembly is increased by rotation of the bolt which forces the piston to move further out of the main body of the locking assembly. Upon further extension of the length of the locking assembly, the locking assembly will eventually force apart the respective portions of the shroud and the carrier such that the shroud is forced harder onto the carrier and prevented from being forced off the carrier. A specific feature of the claimed locking assembly is the way in which the bolt is secured within the main body. Upon assembly of the locking assembly 1, the bolt is inserted into the central recess of the main body where after the balls are moved into the intermediate space between the main body and the retaining means. Once the balls are in place within the intermediate space, the balls engage both the main body and the retaining means such that the bolt cannot be forced out of the central recess of the main body without first removing the balls. The balls provide a very robust connection which is strong enough for the forces involved when pulling the piston back into the main body at disengagement of the locking assembly. Also, the large forces needed for forcing the shroud onto the carrier are absorbed by the first support surface engaging the second support surface close to the first end opening of the main body. Hence, the present locking assembly is improved over prior art locking assemblies by providing a more robust design.

The first recess and the second recess may be shaped and positioned to allow the balls a predetermined amount of axial movement along the longitudinal axis relatively the main body and/or relatively the retaining means, such that the balls are not axially loaded when the first bearing surface touches the second bearing surface.

By so providing for a predetermined amount of axial play, the balls remain substantially axially unloaded such that large forces are absorbed by the first and second bearing surfaces at feeding of the piston out of the main body when locking the shroud to the carrier.

When configured according to alternative b) above, the retaining means and the bolt may be configured to allow a predetermined axial play between the bolt and the retaining means when the first bearing surface touches the second bearing surface. As indicated above, it may be desirable to keep the stress on the retaining means low in order not to damage the retaining means at extension of the locking assembly. Generally, the amount of stress that can be handled by the first and the second bearing surfaces is higher than the stress that the retaining means is able to handle without deforming or being damaged. Hence, a further mechanism for ensuring the main stresses at extension of the locking assembly are kept away from the retaining means is to make the retaining means movable with respect to the bolt and ensure there is an axial play between the bolt 6 and the retaining means 12 when the first bearing surface 9 touches the second bearing surface 10. After the balls have been introduced into the intermediate recess as described above, the amount of axial relative movement between the retaining means and the main body is governed by any play around the balls. However, with the current configuration in which the retaining means is not integrated with the bolt but provided as a separate part, the bolt is freely movable away from the retaining means into the housing until the first bearing surface abuts the second bearing surface. From there, the bolt is again freely movable a predetermined distance outwards of the main body along the longitudinal axis of the main body until some portion of the bolt hits the retaining means. From there, the mechanical interference between the retaining means and the bolt prevents further movement outwards of the bolt such that the bolt can be still used to pull the piston back into the main body upon rotation of the bolt.

The main body or the bolt is provided with a passage connecting the intermediate space to the outside of the locking assembly such that the plurality of balls are movable into the intermediate space through the passage. The passage provides a means for getting the balls into the intermediate space whilst preferably also enabling the balls to be moved out of the intermediate space for disassembly, inspection and maintenance of the locking assembly.

The passage may be provided with a closure means for closing the passage.

The provision of such a closure means ensures the balls are kept in the intermediate space and prevents dust and dirt from entering the intermediate space, thereby improving reliability of the locking assembly.

The main body and the piston may be provided with corresponding guide means configured such that the piston is guided for movement along the longitudinal axis and such that the piston is prevented from co-rotating with the bolt. The provision of such a guide means prevents the piston from rotating about the longitudinal axis and thus enables a rotation of the bolt to cause the threads to move the piston along the longitudinal axis. Hence, such a configuration enables installation and removal of the shroud without use of a special tool for preventing rotation of the piston.

The guide means may comprise at least one protrusion provided on the piston and extending radially outwards from the piston, wherein the main body is provided with at least one support surface or recess extending parallel to the longitudinal axis, wherein the support surface or recess is configured to guide the protrusion along the longitudinal axis and to prevent rotation of the piston.

The protrusion and the support surface together provide a simple means for preventing rotation of the piston about the longitudinal axis whilst allowing the piston to move back and forth along the longitudinal axis.

According to a second aspect, this object is also achieved by a shroud system comprising a shroud, a locking assembly as described above, and a lug or boss attachable to the carrier to provide a means for the piston of the locking assembly to engage such that the main body moves relative to the lug or boss upon rotation of the bolt.

BRIEF DESCRIPTION OF DRAWINGS

FIG. 5 shows insertion of the locking assembly into a corresponding opening of the shroud.

FIG. 6 shows rotation of the bolt of the locking assembly for extension of the locking assembly in order to force the shroud further onto the carrier towards its mounted use position.

FIG. 7 shows dismounting of the shroud by rotation of the bolt in the opposite direction to the direction shown in FIG. 6, wherein the main body of the locking assembly abuts an outer portion of the shroud to force it off the carrier.

| | |
|---|---|
| 1 | locking assembly |
| 2 | shroud |
| 3 | carrier |
| 4 | piston |
| 5 | main body |
| 6 | bolt |
| 7 | gripping portion |
| 8 | first end opening |
| 9 | first bearing surface |
| 10 | second bearing surface |
| 11 | longitudinal axis |
| 12 | retaining means |
| 13 | intermediate space |
| 14 | balls |
| 15 | passage |
| 16 | protrusion of guide means |
| 17 | support surface of guide means |
| 18 | lug or boss |
| 19 | protruding portion of main body |
| D1 | first direction |
| D2 | second direction |
| PA30 | Prior art locking assembly |
| PA110 | Prior art locking assembly - exploded view |

DETAILED DESCRIPTION

A locking assembly 1 according to a first embodiment will hereinafter be described with reference to the appended drawings.

Figure 1:
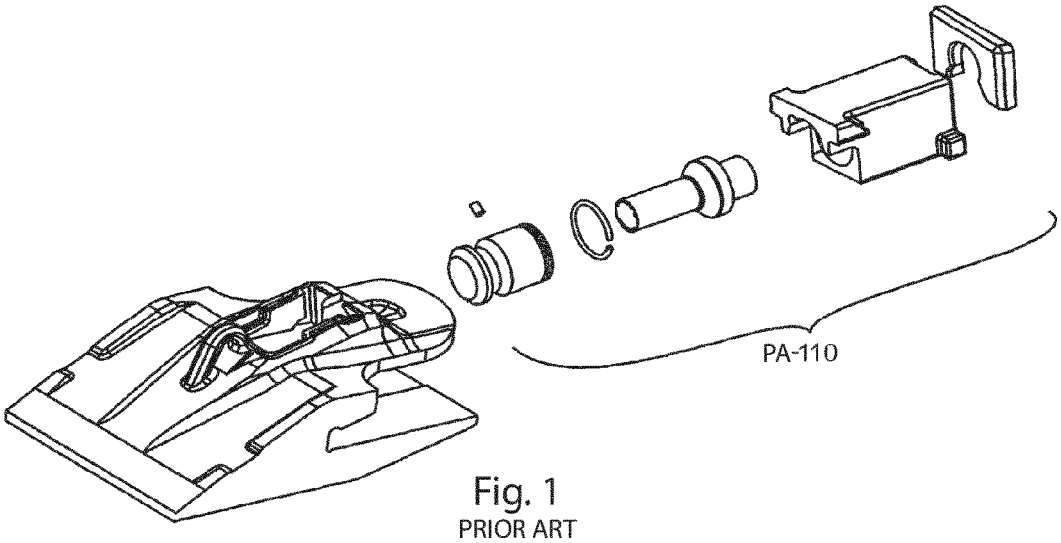
Fig. 1 PRIOR ART
FIG. 1 shows a prior art shroud and a corresponding prior art locking assembly for releasably locking the shroud to a carrier.
Figure 2:
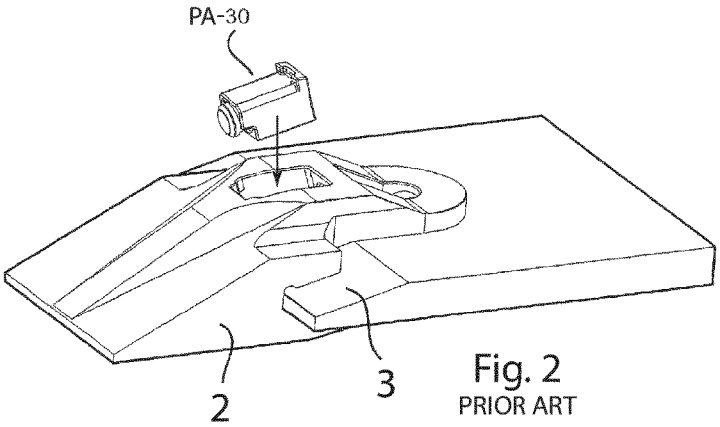
Fig. 2 PRIOR ART
FIG. 2 shows the prior art shroud and the locking assembly also shown in FIG. 1 with the shroud positioned on the carrier.
Figure 3:
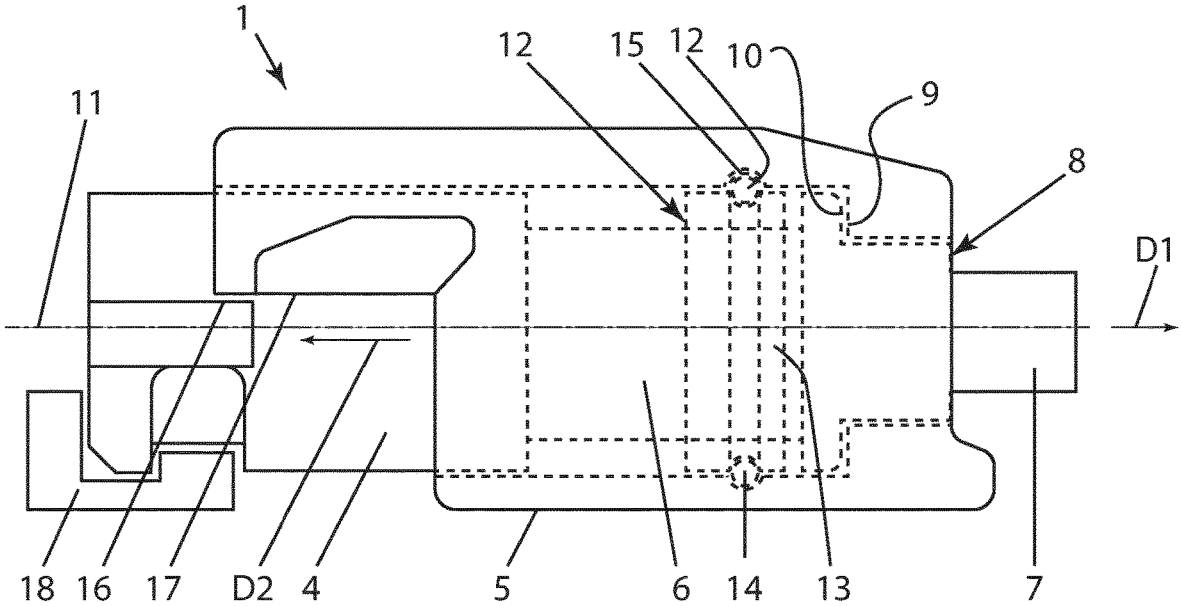
FIG. 3 shows with semi-transparent parts a first embodiment of a new locking assembly.
Figure 5:
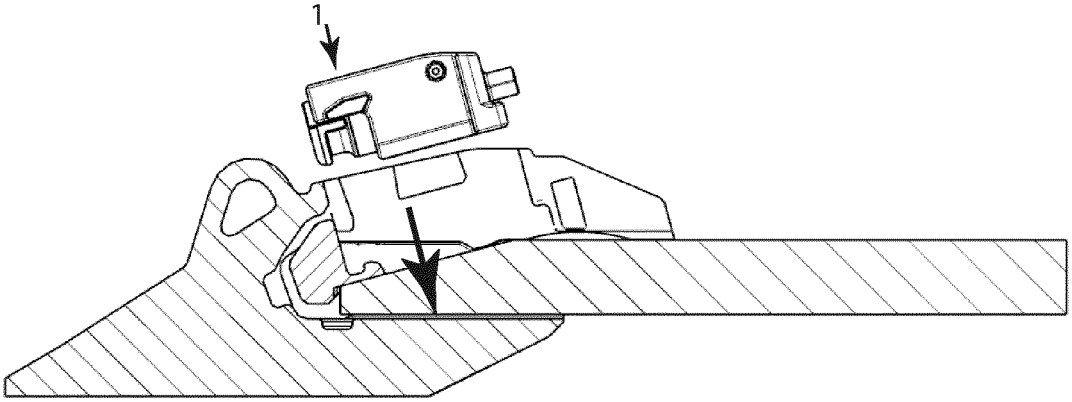
FIGS. 5-7 show the locking assembly also shown in FIG. 3, together with the shroud and the carrier also shown in FIG. 4, in different stages of mounting and dismounting of the shroud to the carrier.

As for example shown in FIGS. 3 and 5, the locking assembly 1 is for use with a shroud and a carrier and works on the same principle as the prior art locking assembly PA-110 shown in FIGS. 1 and 2.

Figure 4:
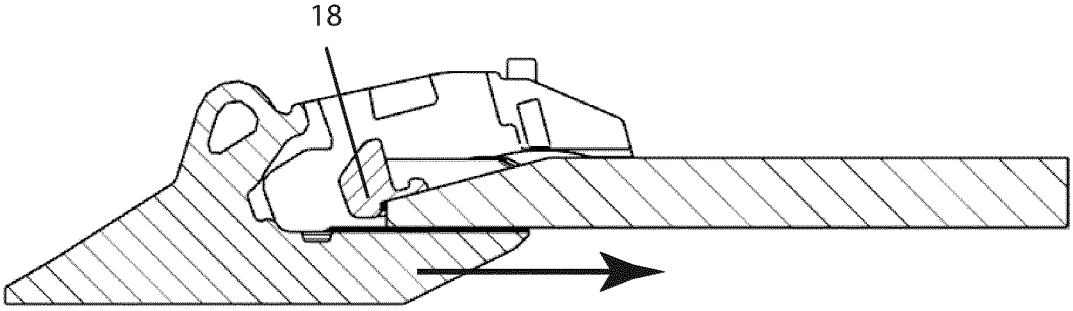
FIG. 4 shows a shroud and a carrier for use with the locking assembly also shown in FIG. 3. An arrow indicates the shroud being forced onto the carrier.
Figure 6:
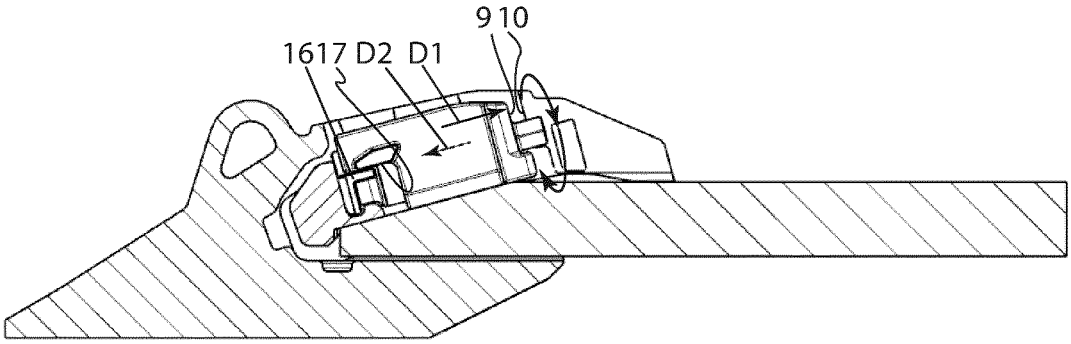

The locking assembly 1 is for releasably locking the shroud 2 to a carrier 3. Mounting of the shroud to the carrier using the locking assembly is illustrated in FIGS. 4-6

The locking assembly 1 comprises a piston 4 and a main body 5 provided with a through central recess for receiving the piston 4 such that the piston 4 is movable back and forth along a longitudinal axis 11 of the central recess with an outer end portion of the piston 4 extending outside the central recess of the main body 5. The locking assembly 1 further comprises a bolt 6 provided within the central recess, wherein the bolt 6 comprises a shank and a gripping portion 7 extending through a first end opening 8 of the central recess such that the gripping portion 7 is accessible from outside the main body 5 for rotation of the bolt 6. At least a portion of the shank is provided with a thread engaging a corresponding thread of the piston 4. Also, the bolt 6 is provided with a first bearing surface 9 facing a corresponding second bearing surface 10 of the main body. The first 9 and second 10 bearing surfaces are configured such that when the bolt 6 is rotated to force the piston 4 out of the central recess, the first bearing surface 9 of the bolt bears against the second bearing surface 10 of the main body 5 thereby forcing the main body in a first direction D1 along the longitudinal axis 11. The locking assembly 1 further comprises a retaining means 12 (see FIG. 3) for preventing movement of the bolt 6 in a second direction D2 (see FIG. 6) opposite the first direction D1. The retaining means 12 is provided in the central recess with an outer surface of the retaining means facing an inner surface of the central recess. The outer surface of the retaining means 12 is provided with a first recess extending at least partly around the circumference of the retaining means 12, wherein the inner surface of the central recess is provided with a second recess extending at least partly around the circumference of the inner surface of the main body 5, wherein the first recess and the second recess jointly define an intermediate space 13 for receiving a plurality of balls 14 distributed about the longitudinal axis such that the balls 14 limit movement of the retaining means 12 in the second direction D2 relative to the main body 5. In this embodiment the retaining means 12 is provided as a separate part positioned around the shank of the bolt 6 and adapted to limit movement of the bolt 6 relative to the retaining means 12 in the second direction D2. However, the retaining means 12 could in other embodiments alternatively be integrated with the bolt 6, for example attached to the bolt or integrally formed with the bolt.

The retaining means 12 and the bolt 6 are configured to allow a predetermined axial play between the bolt 6 and the retaining means 12 when the first bearing surface 9 touches the second bearing surface 10. The play ensures that the retaining means 12 is not loaded when the locking assembly 1 forces the shroud 2 onto the carrier 3 upon mounting of the shroud 2 to the carrier 3.

Figure 7:
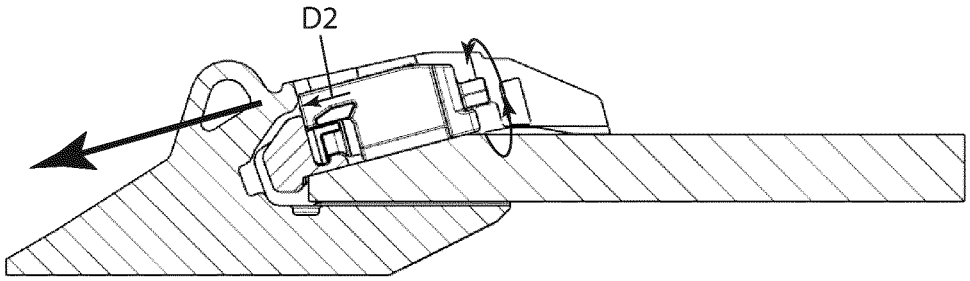
Figure 8:
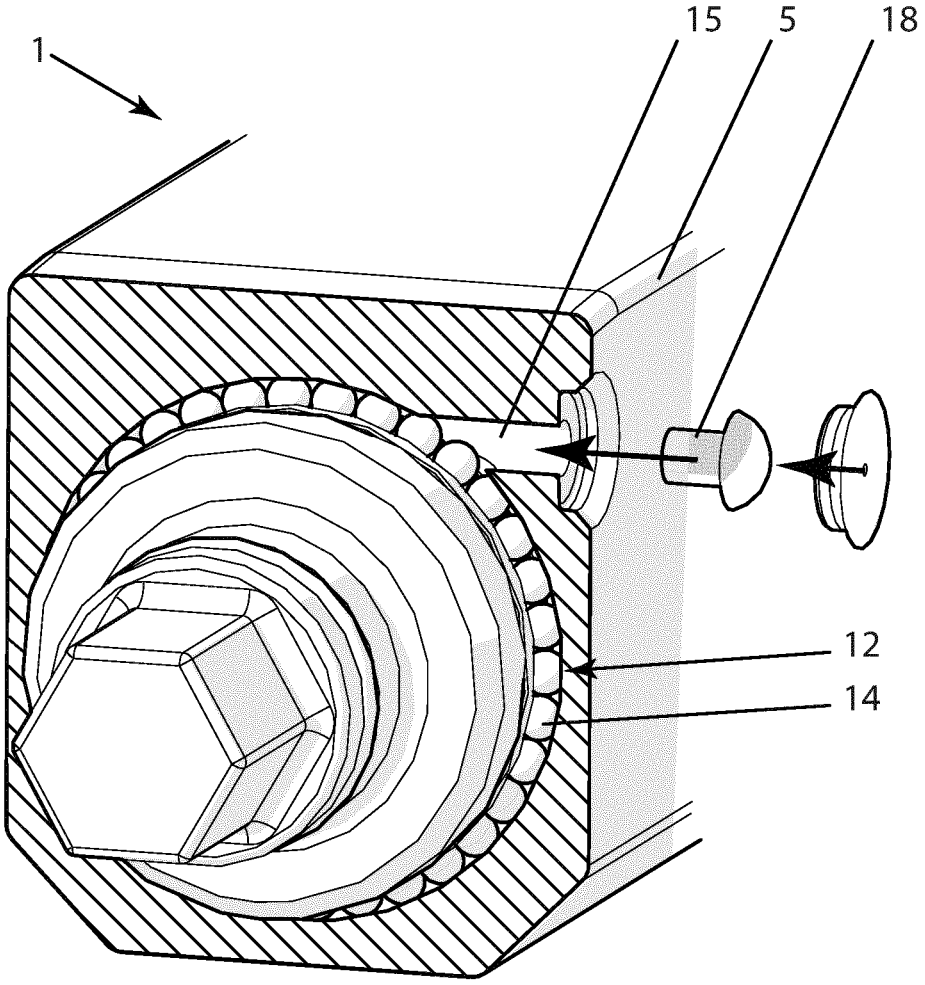
FIG. 8 shows the retaining means of the locking assembly with the main body shown in cross section for revealing the passage through which the balls have been introduced into the intermediate space of the retaining means and with the closure means shown in exploded state as indicated by the arrows.

The main body 5 or the bolt is provided with a passage 15 connecting the intermediate space 13 to the outside of the locking assembly 1 such that the plurality of balls 14 are movable into the intermediate space 13 through the passage 15 for assembly of the locking assembly 1. After the balls 14 have been inserted into the intermediate space, the passage 15 has been provided with a closure means 18 for preventing balls 14 from leaving the intermediate space 13 through the passage 15. The closure means 18 is shown in FIG. 7 exploded from its mounted position in the passage 15. In this embodiment, the closure means 18 is a metal plug which is welded in place. However, other materials and means of attaching the plug may alternatively be provided in other embodiments. Also, the closure means 18 may alternatively instead of being welded in place, be removable such as to enable easy access to the passage for removal or lubrication of the balls 14.

As shown in FIGS. 3 and 6*p*, the main body 5 and the piston 4 are provided with corresponding guide means 16, 17 configured such that the piston 4 is guided for movement along the longitudinal axis 11 and such that the piston 4 is prevented from rotating about the longitudinal axis 11 relative to the main body 5. The guide means comprises at least one protrusion 16 provided on the piston 4 and extending radially outwards from the piston 4. The main body 5 is provided with a left and a right support surface 17 provided on a respective left and right protruding portion 19 and/or by the 'overhang' of the main body availing the support surfaces 17. In other embodiments, one or more recesses may be provided instead of the protrusions in order to instead provide the support surface(s) 17 inside the recesses. Preferably, such recesses would extend parallel to the longitudinal axis 11 although the recesses or the protrusions 19 could be slightly curved as long as co-rotation of the piston at rotation of the bolt 6 is prevented and longitudinal displacement is allowed. Hence, the support surface 17 or recess is configured to guide the protrusion 16 along the longitudinal axis 11 and to prevent rotation of the piston 4.

Instead of, or in addition to, providing a predetermined axial play between the retaining means 12 and the bolt 6, the first recess and the second recess may alternatively be shaped and positioned to allow the balls 14 a predetermined amount of axial movement along the longitudinal axis 11 relatively the main body 5 and/or relatively the retaining means 12, such that the balls 14 are not axially loaded when the first bearing surface 9 touches the second bearing surface 10.

In an embodiment according to the second aspect, a shroud system is provided, wherein the shroud system comprises the shroud 2, the above described locking assembly 1, and a lug or boss 18 attachable to the carrier 3 to provide a means for the piston 4 of the locking assembly 1 to engage such that the main body 5 moves relative to the lug or boss 18 upon rotation of the bolt 6. The lug or boss 18 is shown in cross-section in FIGS. 4-6. The lug or boss 18 has a central recessed portion for receiving an outer portion of the piston 4 of the locking assembly 1 in an insertion direction shown by the large arrow in FIG. 5. Also, the lug or boss 18 and the outer portion of the piston 4 are provided with respective mating protrusions and recesses configured to engage at insertion of the locking assembly 1 along the insertion direction and then prevent relative displacement between the piston 4 and the lug or boss 18 along the longitudinal axis 11.

At mounting of the shroud 2 to the carrier 3, the shroud 2 is first moved onto the carrier 3 as shown in FIG. 4. Once the central recess of the shroud 2 is aligned with the lug or boss 18 provided on the carrier 3, the locking assembly 1 is inserted into the central recess of the shroud 2 as shown in FIG. 5. The outer portion of the piston 4 of the locking assembly 1 engages the lug or boss 18 upon insertion. The locking assembly 1 is subsequently expanded by rotation of the its bolt 6 as shown in FIG. 6. Upon expansion/elongation of the locking assembly 1, the locking assembly 1 pushes apart the lug or boss 18 and the shroud 2 to force the shroud 2 further onto the carrier 3 to bring the shroud 2 into its final use position. The shroud 2 seats against the carrier 3 in a fixed use position. Also, the locking assembly 1 uses its first and second bearing surfaces 9, 10 to transfer force from the bolt 6 to the shroud 2 and thus provides a very robust design capable of handling the large stresses involved at use of the carrier 3. It should be understood that the retaining means 12 would most likely not be able to cope with such high forces as those involved at use of the carrier 3 and hence the design provides for the retaining means 12 to be substantially unloaded in use, thereby preventing damage to the retaining means 12.

Sometimes it is necessary to remove the shroud 2 for replacement or service. Merely loosening the locking assembly 1 by reducing its length by rotation of its bolt 6 would not release the shroud 2 which is typically held in place by substantial frictional forces. An advantage of the present locking assembly 1 is that it can be used to force the shroud 2 off the carrier 3. The outer portion of the piston 6 engages the lug or boss 18 and the retaining means 12 keeps the bolt 6 inside the main body 5 at rotation of the bolt 6. This enables the locking assembly 1 to force the main body 5 towards the lip of the carrier 3 until the main body 5 eventually forces the shroud 2 outwards as shown in FIG. 7. It should be noted that the bolt 6 is rotated the opposite direction to the rotational direction shown in FIG. 6. Also, it should be noted that the bolt 6 now transfers force to the main body 5 via the retaining means 12 and not via the first and second bearing surfaces 9, 10. Prior art locking assemblies not exhibiting the present retaining 12 means sometimes fail due to the large forces involved when trying to force a shroud off a carrier. The present locking assembly 1 has a very robust retaining means 12 capable of coping with larger forces than prior art locking assemblies and therefore reduce the risk of failure at dismounting of a shroud from a carrier.

Plastic, rubber or elastomer covers may be mounted on the shroud for protection of the locking assembly. The provision of such covers lowers the risk of having foreign particles, such as dust and dirt, entering the locking assembly 1 and also protects the gripping portion of the bolt 6 from external abuse. Altogether, this improves lifetime of the locking assembly 1 whilst still being easy to remove such that the gripping portion can be operated for dismounting the shroud 2 from the carrier 3.

The invention claimed is:

1. A locking assembly for releasably locking a shroud to a carrier, the locking assembly comprising:

a piston;

a main body provided with a through central recess arranged for receiving the piston such that the piston is movable back and forth along a longitudinal axis of the recess with an outer end portion of the piston extending outside the central recess of the main body;

a bolt provided within the central recess, wherein the bolt includes a shank and a gripping portion extending through a first end opening of the central recess such that the gripping portion is accessible from outside the main body for rotation of the bolt, wherein at least a portion of the shank is provided with a thread engaging a corresponding thread of the piston, wherein the bolt is provided with a first bearing surface facing a corresponding second bearing surface of the main body, wherein the first and second bearing surfaces are configured such that when the bolt is rotated to force the piston out of the central recess, the first bearing surface of the bolt bears against the second bearing surface of the main body thereby preventing movement of the bolt in a first direction along the longitudinal axis; and a retaining means arranged for preventing movement of the bolt in a second direction opposite the first direction, wherein the retaining means is provided in the central recess with an outer surface of the retaining means facing an inner surface of the central recess, wherein the outer surface of the retaining means is provided with a first recess extending at least partly around a circumference of the retaining means, wherein the inner surface of the central recess is provided with a second recess extending at least partly around a circumference of the inner surface of the main body, wherein the first recess and the second recess jointly define an intermediate space arranged for receiving a plurality of balls distributed about the longitudinal axis such that the plurality of balls limit movement of the retaining means in the second direction relative to the main body, and wherein the retaining means is either integrated with the bolt, or provided as a separate part positioned around the shank of the bolt and adapted arranged to limit movement of the bolt relative to the retaining means in the second direction.

2. The locking assembly according to claim 1, wherein the first recess and the second recess are shaped and positioned to allow the plurality of balls a predetermined amount of axial movement along the longitudinal axis relative to the main body and/or relative to the retaining means, such that the plurality of balls are not axially loaded when the first bearing surface touches the second bearing surface.

3. The locking assembly according to claim 1, wherein the retaining means and the bolt are configured to allow a predetermined axial play between the bolt and the retaining means when the first bearing surface touches the second bearing surface.

4. The locking assembly according to claim 1, wherein the main body or the bolt is provided with a passage connecting the intermediate space to an outside of the locking assembly such that the plurality of balls are movable into the intermediate space through the passage.

5. The locking assembly according to claim 4, wherein the passage is provided with a closure means arranged for closing the passage.

6. The locking assembly according to claim 1, wherein the main body and the piston are provided with corresponding guide means configured such that the piston is guided for movement along the longitudinal axis and such that the piston is prevented from co-rotating with the bolt.

7. The locking assembly according to claim 6, wherein the guide means includes at least one protrusion provided on the piston and extending radially outwards from the piston, wherein the main body is provided with at least one support surface or recess extending parallel to the longitudinal axis, and wherein the support surface or recess is configured to guide the protrusion along the longitudinal axis and to prevent rotation of the piston.

8. A shroud system for a carrier, the shroud system comprising:

a shroud;

a locking assembly according to claim 1; and a lug or boss attachable to the carrier to provide a means for the piston of the locking assembly to engage such that the main body moves relative to the lug or boss upon rotation of the bolt.

* * * * *